US010478682B2

(12) United States Patent
Ueda et al.

(10) Patent No.: US 10,478,682 B2
(45) Date of Patent: Nov. 19, 2019

(54) GOLF CLUB SET

(71) Applicant: Sumitomo Rubber Industries, Ltd., Kobe-shi, Hyogo (JP)

(72) Inventors: Naoyoshi Ueda, Kobe (JP); Masahiko Ueda, Kobe (JP); Shimpei Oyama, Kobe (JP); Yasushi Sugimoto, Kobe (JP); Takashi Nakamura, Kobe (JP); Tomoya Hirano, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/965,241

(22) Filed: Apr. 27, 2018

(65) Prior Publication Data

US 2018/0311540 A1 Nov. 1, 2018

(30) Foreign Application Priority Data

Apr. 28, 2017 (JP) ..... 2017-089827

(51) Int. Cl.

| | |
|---|---|
| ***A63B 53/00*** | (2015.01) |
| ***A63B 53/04*** | (2015.01) |
| ***A63B 69/36*** | (2006.01) |
| *A63B 102/32* | (2015.01) |

(52) U.S. Cl.

CPC ..... *A63B 53/047* (2013.01); *A63B 69/3617* (2013.01); *A63B 2053/005* (2013.01); *A63B 2053/0445* (2013.01); *A63B 2053/0479* (2013.01); *A63B 2053/0483* (2013.01); *A63B 2102/32* (2015.10)

(58) Field of Classification Search

USPC ..... 473/288–291, 324–350

See application file for complete search history.

(56) References Cited

U.S. PATENT DOCUMENTS 4,854,581 A * 8/1989 Long ..... A63B 53/00 473/290
5,433,439 A * 7/1995 Hsien ..... A63B 53/04 473/290

(Continued)

FOREIGN PATENT DOCUMENTS

JP 9-192274 A 7/1997
JP 2007-7181 A 1/2007

*Primary Examiner* — Alvin A Hunter

(74) *Attorney, Agent, or Firm* — Birch, Stewart, Kolasch & Birch LLP

(57) ABSTRACT

A golf club set includes at least one first golf club whose loft angle is not less than 46 degrees and less than 56 degrees, and at least one second golf club whose loft angle is not less than 56 degrees and less than 60 degrees. The first and second golf clubs each comprise a face provided with score lines each formed by a groove having a groove bottom and a pair of opposite grooves walls which are inclined at an inclination angle with respect to a normal direction to the face so that the groove width between the opposite grooves walls is increased from the groove bottom toward the face. The inclination angle of the groove walls of the score lines of the first golf club is in the range from 28 to 42 degrees. The inclination angle of the groove walls of the score lines of the second golf club is in the range from 23 to 37 degrees and smaller than that of the first golf club.

14 Claims, 9 Drawing Sheets

(56) References Cited

U.S. PATENT DOCUMENTS

| | | | | |
|---|---|---|---|---|
| 5,595,547 | A * | 1/1997 | Lekavich | A63B 53/00 473/287 |
| 5,766,087 | A * | 6/1998 | Kawamatsu | A63B 53/04 473/290 |
| 6,224,495 | B1 * | 5/2001 | Teramoto | A63B 53/00 473/287 |
| 7,014,568 | B2 * | 3/2006 | Pelz | A63B 53/04 473/287 |
| 7,179,175 | B2 * | 2/2007 | Kennedy, III | A63B 53/04 473/330 |
| 9,370,699 | B1 * | 6/2016 | Ines | A63B 53/047 |

* cited by examiner comparative example
embodiment
B = 17.5°
B = 30.0°
ball
face
groove wall
groove bottom

GOLF CLUB SET

TECHNICAL FIELD

The present invention relates to a golf club set including golf clubs having different loft angles.

BACKGROUND ART

The following Patent Document 1 discloses a golf club set aiming at obtaining the struck ball with proper backspin commensurate with to the club number of the respective club. This golf club set is composed of golf clubs whose loft angles are increased as the club number becomes increased. And the score lines or grooves formed in the ball striking face of the respective golf club are configured such that the angle of the corner formed between the ball striking face and an inclined surface of the groove is gradually decreased as the club number becomes increased, wherein the angle is 90 degrees in the pitching wedge.

The following Patent Document 2 discloses an iron golf club set aiming at providing the iron golf club set with which it is easy to stop the golf ball when making a short-distance approach shot by using an iron club whose club number is more than that of a sand wedge, and it is easy to obtain a stable trajectory and a proper distance when making a full shot by using an iron club whose club number is smaller than that of a sand wedge. In the Patent Document 2, it is suggested that the groove edges of the score lines (grooves) of the sand wedge are rounded by a radius of 0.1 mm, and the groove edges of the score lines (grooves) of the rest of the clubs from 5-iron to the approach wedge are rounded by a radius of 0.3 mm.

Patent Document 1:

Japanese Patent Application Publication No. H09-192274

Patent Document 2:

Japanese Patent Application Publication No. 2007-007181

SUMMARY OF THE INVENTION

As described in the Patent Documents 1 and 2, it has been known to change parameters (e.g., the corner angle of the score lines formed in the face of the golf club head and the radius of the rounded groove edges of the score lines) depending on the club number of golf clubs, namely, depending on the loft angles.

In these prior arts, however, actual states of golf clubs during striking a ball are not taken into account sufficiently, therefore, there is room for improvement in increasing the backspin of the struck ball.

The present invention was made in view of the above problems, and a main object of the present invention is to provide a golf club set capable of increasing the backspin of the ball when struck by the golf club having a large loft angle.

According to the present invention, a golf club set comprises golf clubs having different loft angles, the above-said golf clubs include at least one first golf club whose loft angle is not less than 46 degrees and less than 56 degrees, and at least one second golf club whose loft angle is not less than 56 degrees and less than 60 degrees, the above-said at least one first golf club and the above-said at least one second golf club each comprise a face provided with score lines, the score lines are each formed by a groove having a groove bottom and a pair of opposite grooves walls which are inclined at an inclination angle with respect to a normal direction to the face so that the groove width between the opposite grooves walls is increased from the groove bottom toward the face, and the inclination angle of the groove walls of the score lines of the above-said at least one first golf club is in a range from 28 to 42 degrees, and the inclination angle of the groove walls of the score lines of the above-said at least one second golf club is in a range from 23 to 37 degrees and smaller than that of the first golf club.

Further, the golf club set according to the present invention may include the following features (1)-(5):

(1) the inclination angle of the groove walls of the score lines of the first golf club is in a range from 30 to 40 degrees, and the inclination angle of the groove walls of the score lines of the second golf club is in a range from 25 to 35 degrees and less than that of the first golf club;

(2) the inclination angle of the groove walls of the score lines of the first golf club is in a range from 32 to 38 degrees, and the inclination angle of the groove walls of the score lines of the second golf club is in a range from 27 to 33 degrees and less than that of the first golf club;

(3) the above-said golf clubs include at least one third golf club whose loft angle is more than 60 degrees and not more than 64 degrees, the above-said at least one third golf club comprises a face provided with score lines each formed by a groove having a groove bottom and a pair of opposite grooves walls which are inclined at an inclination angle with respect to a normal direction to the face so that the groove width therebetween is increased from the groove bottom toward the face, and the inclination angle of the groove walls of the score lines of the above-said at least one third golf club is in a range from 20 to 30 degrees and smaller than that of the second golf club;

(4) the above-said at least one first golf club and the above-said at least one second golf club each have a catch angle C in a range of from 6 to 20 degrees, wherein the catch angle C is defined by the following formula (II), $$C=90(\text{deg.})-A(\text{deg.})-B(\text{deg.}) \quad \text{(II)}$$

wherein

B is the inclination angle of the groove walls of the score lines of the golf club concerned, and A is the dynamic loft angle defined by the following formula (I), $$A=A'-\delta \quad \text{(I)}$$

wherein

A' is the loft angle of the golf club concerned, and

δ is an angle value selected from a range from 8 to 10 degrees;

(5) the catch angle C is in a range from 10 to-15 degrees.

In the golf club set according to the present invention, therefore, as the first and second golf clubs are specifically limited with respect to the inclination angle of the groove walls of the score lines, such clubs can produce more backspin on the struck ball.

BRIEF DESCRIPTION OF THE DRAWINGS

FIGS. 6(A)-6(C) show contact states between a ball and score lines of golf clubs as an embodiment and a comparative example, wherein FIG. 6(A) shows cross-sectional views of score lines and balls, FIG. 6(B) shows contact areas viewed from the back side thereof, and FIG. 6(C) shows contact portions viewed from a diagonally side thereof.

DESCRIPTION OF THE PREFERRED EMBODIMENTS

Embodiments of the present invention will now be described with reference to the accompanying drawings.

According to the present invention, a golf club set includes a plurality of (different types of) golf clubs having different loft angles.

Each golf club (generically "1") comprises a golf club head 2 for hitting a ball and a club shaft s whose tip end is fixed to the head 2.

Figure 1A:
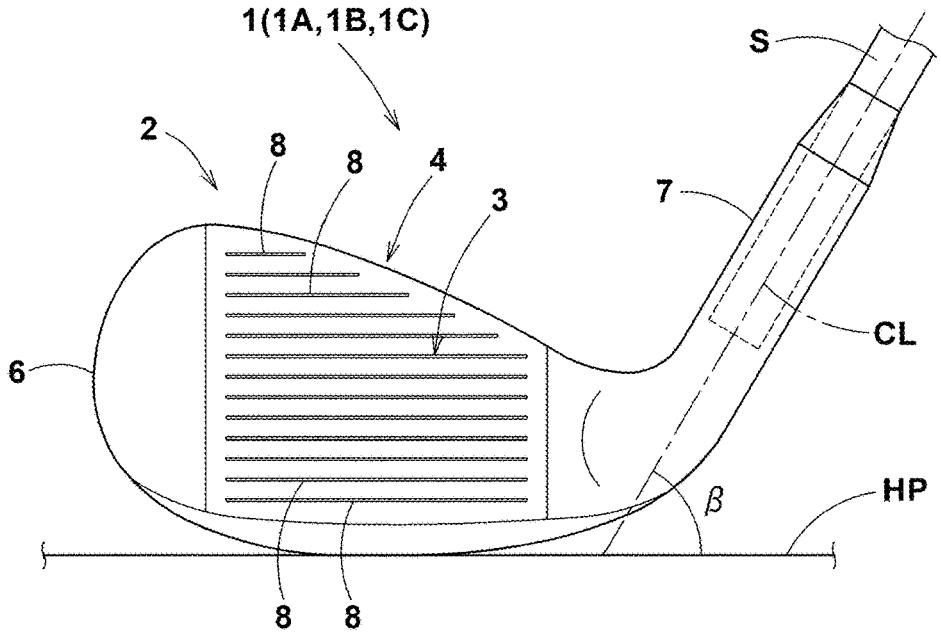
FIG. 1(A) is a front view of a golf club included in a golf club set as an embodiment of the present invention.
Figure 1B:
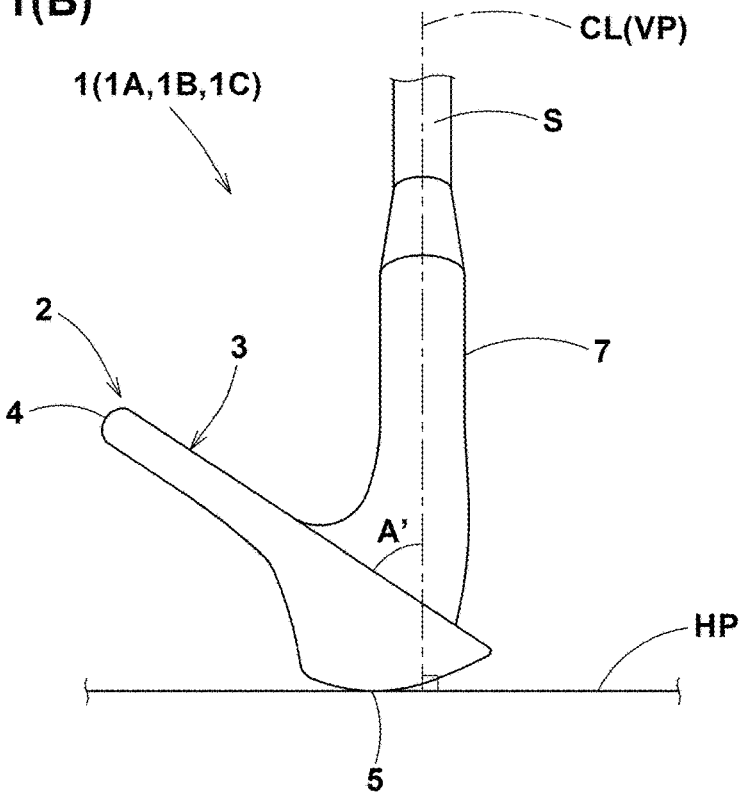
FIG. 1(B) is a side view thereof.

FIGS. 1(A) and 1(B) are a front view and a side view from the toe side, respectively, of one of the golf clubs 1 included in the golf club set as an embodiment of present invention.

In FIGS. 1(A) and 1(B), the golf club 1 is placed in its standard state.

In this specification, the "standard state" of a golf club is such that the club head 2 is set on a horizontal plane HP so that the central axis CL of the club shaft s is placed in a vertical plane VP perpendicular to the horizontal plane HP, and the score lines 8 formed on the face 3 of the club head become parallel to the horizontal plane HP and also parallel to the vertical plane VP.

The above-mentioned loft angle is the angle A' (see FIG. 1(B)) between the face 3 in the standard state and the vertical plane VP.

Incidentally, a lie angle is the angle β (see FIG. 1(A)) between the central axis CL of the club shaft in the standard state and the horizontal plane HP.

In the present embodiment, the golf club set is a set of iron-type golf clubs. This illustrated example of the golf club 1 is formed as a typical iron-type golf club.

The golf club head 2 of a typical iron-type comprises a face 3, a top 4, a sole 5, a toe 6 and a hosel 7.

The face 3 is a substantially planar surface for hitting a ball.

The top 4 is a top surface of the head 2 which extends rearward from the upper edge of the face 3.

The sole 5 is a bottom surface of the head 2 which extends rearward from the lower edge of the face 3.

The tow 6 is a part which is most distant from the hosel 7.

The hosel 7 is a part to which the tip end of the club shaft s is attached. In this example, the hosel 7 is formed in a cylindrical shape.

The golf clubs 1 of the golf club set according to the present invention includes at least one first golf club 1A and at least one second golf club 1B. Further, the golf club set may include a golf club other than the above.

In the present embodiment, the golf club set includes at least one first golf club 1A, at least one second golf club 1B and at least one third golf club 1C.

In another embodiment, a golf club set may include at least one first golf club 1A, at least one second golf club 1B, at least one third golf club 1C, and at least one fourth golf club.

Each first golf club 1A is defined as having a loft angle in a range of not less than 46 degrees and less than 56 degrees.

When the golf club set includes a plurality of the first golf clubs 1A, they are generically referred as the "first group". The first golf clubs 1A in the first group may have two or more different loft angles.

The first golf clubs 1A are those used in a situation where the golfer aims a distance of about 100 yards from the approach.

Thus, the first golf clubs 1A include a pitching wedge (PW) and an approach wedge (AW) for example.

Each second golf club 1B is defined as having a loft angle in a range of not less than 56 degrees and less than 60 degrees.

When the golf club set includes a plurality of the second golf clubs 1B, they are generically referred as the "second group". The second golf clubs 1B in the second group may have two or more different loft angles.

The second golf clubs 1B are those mainly used in a situation where the golfer aims a distance of 60 yards or less such as approach shots and bunker shots.

Thus, the second golf clubs 1B include a sand wedge (SW).

Each third golf club 1C is defined as having a loft angle in a range of not less than 60 degrees.

When the golf club set includes a plurality of the third golf clubs 1C, they are generically referred as the "third group". The third golf clubs 1C in the third group may have two or more different loft angles.

The third golf clubs 1C are those used in situations such as approach shots and chipping out of deep rough.

Thus, the third golf clubs 1C include a lob wedge (LW).

Each fourth golf club is defined as having a loft angle smaller that of the first golf club 1A, namely, less than 46 degrees. Thus, the fourth golf clubs include 3-iron through 9-iron.

The above-mentioned face 3 is provided with score lines 8 in order to increase the friction between the face 3 and a ball. Each of the score lines 8 is a groove having a groove bottom 8*a* and a pair of opposite groove walls 8*b*.

Figure 2A:
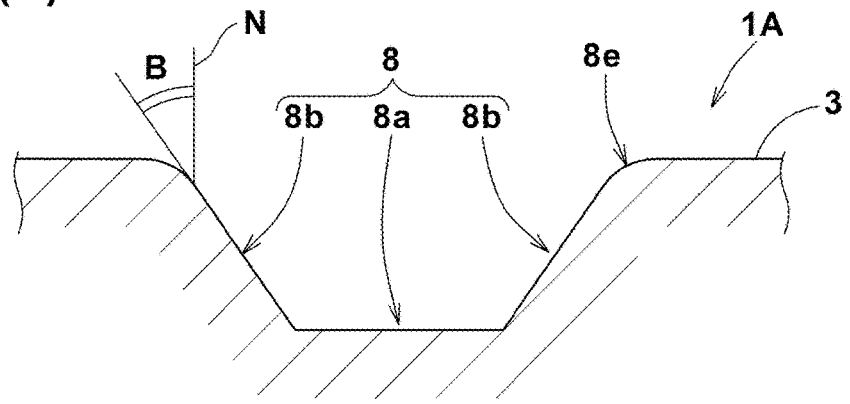
FIG. 2(A) is a cross-sectional view of a score line of a first golf club.

FIG. 2(A) shows a cross-section of the score line 8 formed in the face 3 of the first golf club 1A taken perpendicularly to the longitudinal direction of the score line 8.

Figure 2B:
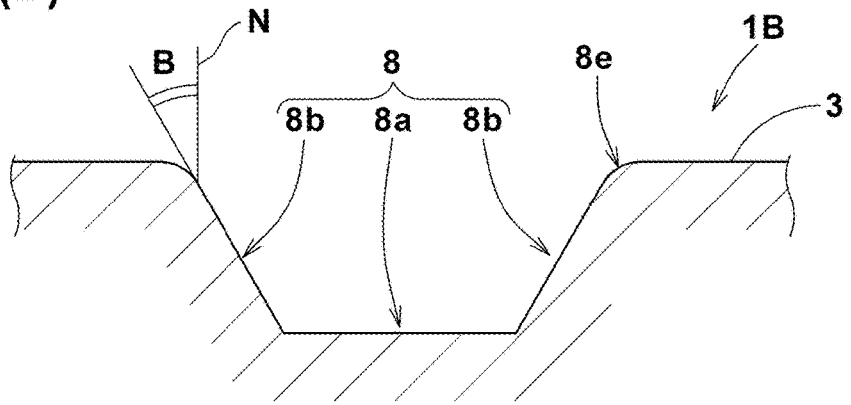
FIG. 2(B) is a cross-sectional view of a score line of a second golf club.

FIG. 2(B) shows a cross-section of the score line 8 formed in the face 3 of the second golf club 1B taken perpendicularly to the longitudinal direction of the score line 8.

Figure 2C:
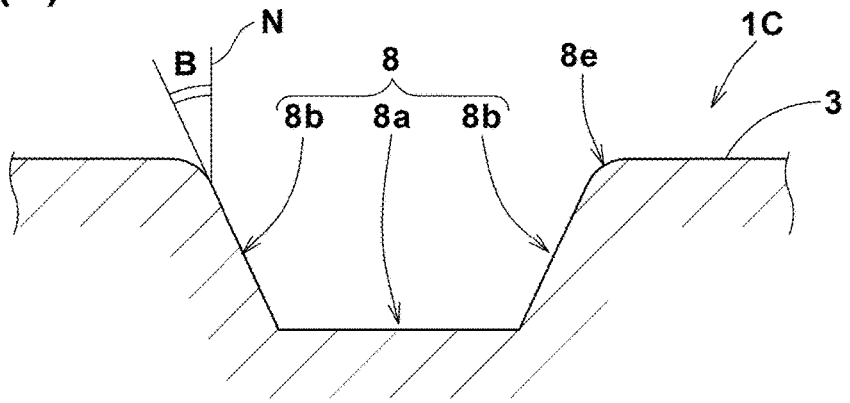
FIG. 2(*c*) is a cross-sectional view of a score line of a third golf club.

FIG. 2(C) shows a cross-section of the score line 8 formed in the face 3 of the third golf club 1C taken perpendicularly to the longitudinal direction of the score line 8.

In each example of the score line 8 shown in FIGS. 2(A)-2(C), the groove bottom 8*a* is formed as a planar surface being parallel to the face 3, and the opposite groove walls 8*b* are inclined outwardly so that the groove width between the opposite groove walls 8*b* increases from the groove bottom 8*a* toward the face 3.

Each of the opposite groove walls 8*b* in the example is a planar surface having an inclination angle B with respect to a normal line N to the face 3.

The opposite groove walls 8*b* are arranged symmetrically about the groove center line of the score line 8.

Incidentally, the terms "parallel" and "symmetrical" are intended to mean "substantially parallel" and "substantially symmetrical" in consideration of the machining accuracy when forming the score lines 8.

The corner 8*e* formed between each groove wall 8*b* and the face 3 is rounded by a predetermined radius of curvature.

The radius of curvature is determined in accordance with the Golf Rules so as to have an effective radius of at least 0.010 inches (0.254 mm).

In order to meet the needs of professional or advanced golfers who want to increase the accuracy of approach shots in golf competitions, the first and second golf clubs 1A and 1B in the present embodiment provide ball-hitting such that the backspin of the ball is increased to stop the ball at the intended location.

For this purpose, the inclination angle B of the groove walls 8*b* of the score lines 8 of each of the golf clubs 1A, 1B and 1C in the present embodiment are set as follows.

In the first golf club 1A, the inclination angle B of the groove walls 8*b* of each score line 8 is set in a range from 28 to 42 degrees.

In the second golf club 1B, the inclination angle B of the groove walls 8*b* of each score line 8 is set in a range from 23 to 37 degrees to be smaller than that of the first golf club 1A. In the third golf club 1C, the inclination angle B of the groove walls 8*b* of each score line 8 is set in the range from 20 to 30 degrees to be less than the second golf club 1B.

The reasons for defining the inclination angles B as above is as follows.

First, when the first and second golf clubs 1A and 1B are used in approach shots, the golf club head strikes the ball placed directly on the lawn. Therefore, for improving the configuration of the score lines 8 in order to increase the backspin of the ball, it is necessary to take into account that the lawn exists between the face 3 and the ball when striking the ball.

Second, it is necessary to recognize that there is a strong correlation between the backspin of the ball and the impulse of a shearing force which the ball receives from the face 3 during contacting with the face 3.

Although, score lines have been considered as one of factors to increase the above-mentioned shearing force, the inventors made a further advanced study, focusing on functions of the groove walls of the score line when taking into account the dynamic loft angle of the club head.

An analysis of approach shots of professional or advanced golfers showed that in many cases, the dynamic loft angle of a golf club was different from its loft angle in the standard state, and in the case of the first and second golf clubs 1A and 1B, the dynamic loft angle was about 8 to 10 degrees smaller than the loft angle in the standard state.

Incidentally, the dynamic loft angle is the inclination angle of the face at the moment of striking a ball, with respect to a vertical line.

Therefore, the inclination angle B of the groove walls 8*b* of the score line 8 should be optimized based on the state of the golf club head positioned at the dynamic loft angle rather than the loft angle in the standard state.

Figure 3A:
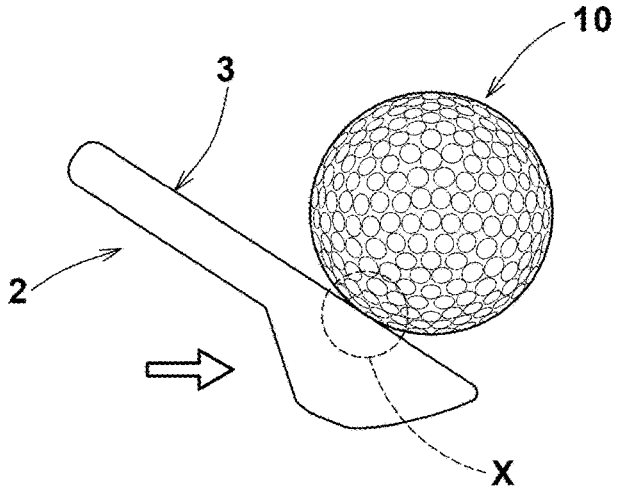
FIG. 3(A) is a schematic side view of a golf club head when hitting a ball.

FIG. 3(A) shows the head 2 and a ball 10 at the moment of striking the ball in an approach shot.

Figure 3B:
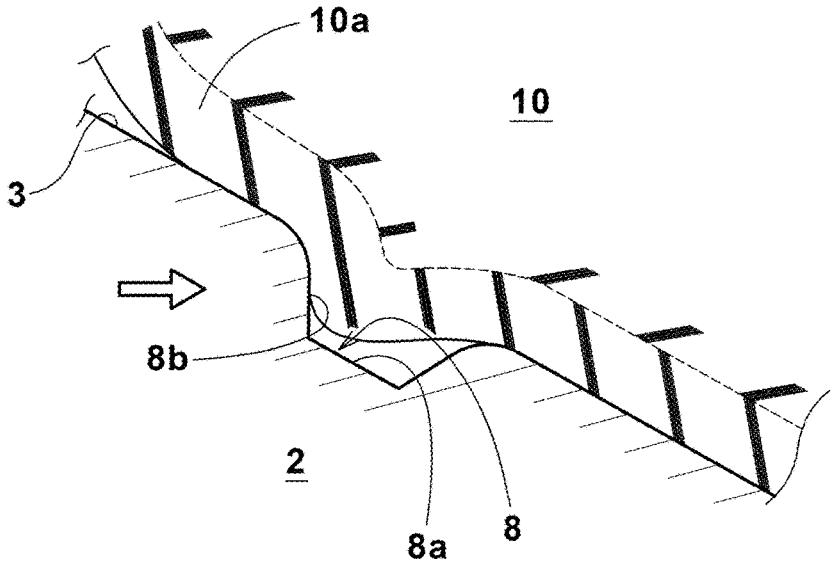
FIG. 3(B) is an enlarged sectional view of a part x of FIG. 3(A).

FIG. 3(B) is an enlarged cross-sectional view showing a part x in FIG. 3(A).

At the time of striking the ball, the surface layer 10*a* of the ball 10 is largely elastically deformed by the face 3 and the score line 8 contacting therewith, and the surface layer 10*a* partly enters in the score line 8 as exaggeratedly shown in FIG. 3(B). Then, the entered portion of the surface layer 10*a* mainly contacts with the groove wall 8*b* positioned on the upper side than the lower side.

The inventors therefore, made experiments and found that it is possible to exert a large shearing force on the ball 10 by improving the groove wall 8*b* on the upper side.

Figure 4:
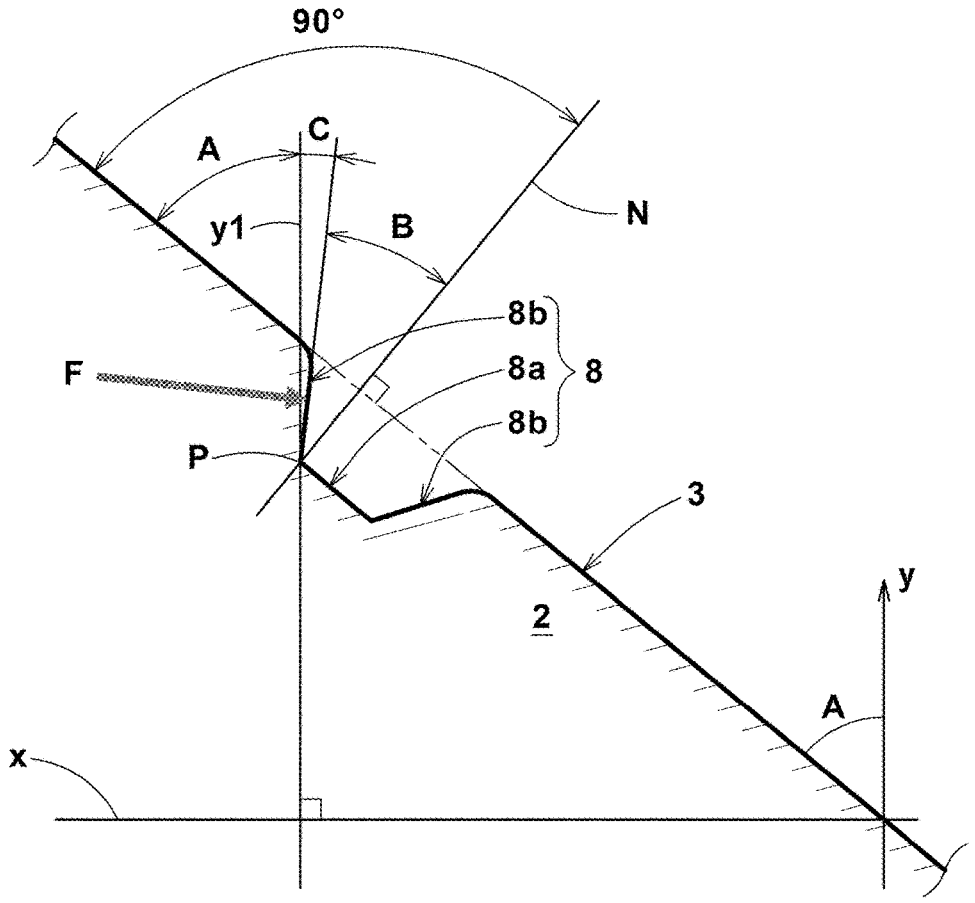
FIG. 4 is a diagram showing the part x.

FIG. 4 schematically shows the part x in FIG. 3(A) excluding the ball, wherein "x" denotes a horizontal direction, and "y" denotes the vertical direction.

In FIG. 4, the face 3 of the head 2 is inclined at a dynamic loft angle "A" with respect to a vertical line.

The inventors found that it is possible to further increase the backspin of the ball by specifically defining a catch angle C.

Here, the catch angle C is an angle obtained by subtracting the inclination angle B in degrees of the groove wall 8*b* of the score line and the dynamic loft angle "A" in degrees from 90 degrees, namely, C=90-A-B.

More specifically it was found that, for the golf club of the high loft angle such as the first golf club 1A and the second golf club 1B, it is important to improve the score line 8 so that the catch angle C becomes a large positive value.

Figure 5:
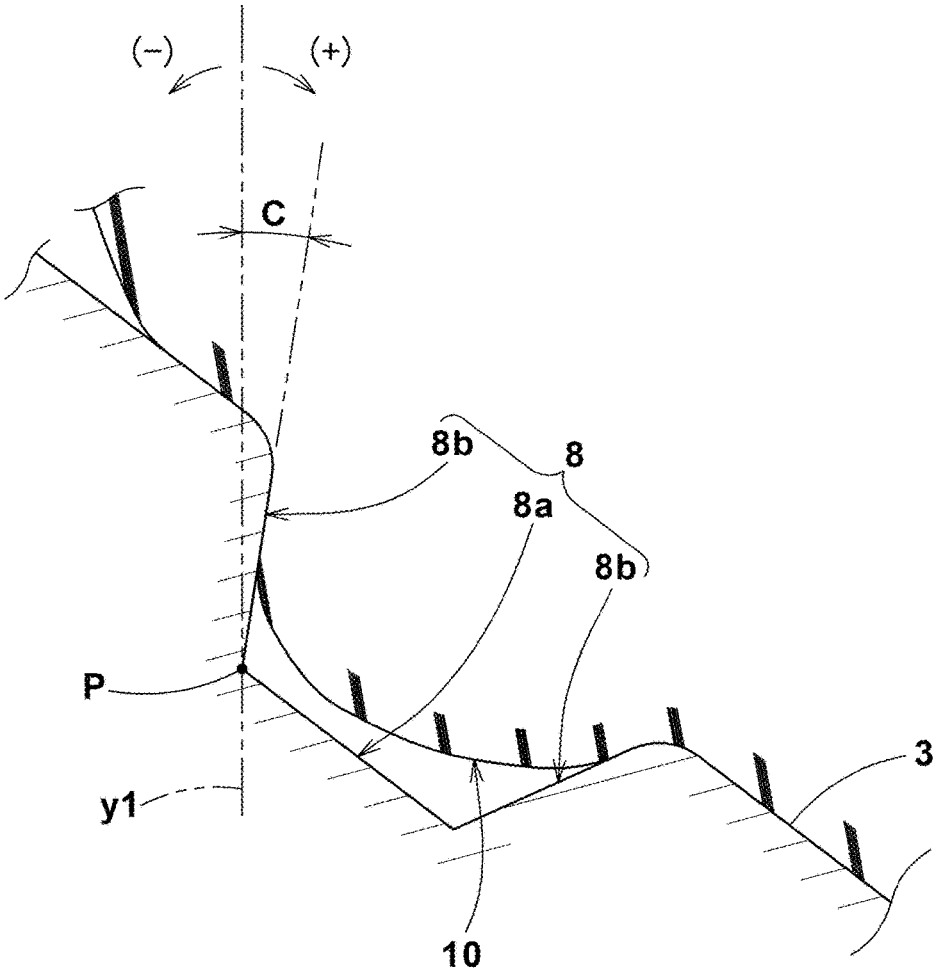
FIG. 5 is an enlarged cross-sectional view of a golf club of the present embodiment showing a contact state between the score line and the ball.

FIG. 5 is an enlarged illustration showing the score line 8 shown in FIG. 4 together with a part of the ball 10.

As shown, the catch angle C of the score line 8 is expressed as a positive (+) when the groove wall 8*b* on the upper side of the score line 8 is inclined toward the target line of the ball (rightward in FIG. 4 and FIG. 5), namely, forward from a vertical line y1 drawn through the intersection P between the groove wall 8*b* and the groove bottom 8*a*. When inclined to the opposite direction, the sign is a negative (−).

In the golf club whose groove wall 8*b* on the upper side of each score line 8 is inclined forward relatively to the vertical line y1 when striking the ball, when the ball comes into contact with the groove wall 8*b* inclined forward as shown in FIG. 5, the surface layer (cover) of the ball 10 is elastically deformed to contact with a large area of the groove wall 8*b* on the upper side, therefore, a very strong physical action to catch the ball 10 (engaging action) can be obtained. Thus, the struck ball 10 is caught by the score line 8 and contact with the score line 8 for a longer time, and a large shearing force F is exerted on the ball 10 for a longer time. Therefore, it is possible to increase the backspin significantly in the first golf club 1A and the second golf club 1B in the present embodiment.

On the other hand, if the catch angle C is 0 or less (negative), then in a situation where lawn exists between the face 3 and the ball when striking the ball, it is difficult to obtain a strong engaging action between them, and a large shearing force can not be exerted on the ball.

With respect to the first golf clubs 1A and the second golf clubs 1B which may be included in a golf club set according to the present invention, an example of values of the loft angles A' and the inclination angles B of the groove walls 8*b* of the score lines 8 is shown in Table 1.

In this example, the minimum value and the maximum value of the inclination angle B are 28 degrees and 42 degrees, respectively, for the first golf clubs 1A, and 23 degrees and 37 degrees, respectively, for the second golf club 1B.

In this Table 1, the values of the dynamic loft angle "A" which were determined assuming that they are 10 degrees smaller than the respective loft angles A' in the standard state, and the catch angles C (=90−A−B) obtained therefrom are also indicated. Additionally, such values of the optional third golf clubs 1C are also indicated.

TABLE 1

| | first golf club | | | | | | | | | | second golf club | | | | | third golf club | |
|---|---|---|---|---|---|---|---|---|---|---|---|---|---|---|---|---|---|
| loft angle A' (deg.) | 46 | 47 | 48 | 49 | 50 | 51 | 52 | 53 | 54 | 55 | 56 | 57 | 58 | 59 | 60 | 61 | 62 |
| inclination angle B (deg.) | 28 | 28 | 28 | 28 | 28 | 28 | 28 | 28 | 28 | 28 | 23 | 23 | 23 | 23 | 23 | 20 | 20 |
| dynamic loft angle A (deg.) | 36 | 37 | 38 | 39 | 40 | 41 | 42 | 43 | 44 | 45 | 46 | 47 | 48 | 49 | 50 | 51 | 52 |
| catch angle C (deg.) | 26 | 25 | 24 | 23 | 22 | 21 | 20 | 19 | 18 | 17 | 21 | 20 | 19 | 18 | 17 | 19 | 18 |
| loft angle A' (deg.) | 46 | 47 | 48 | 49 | 50 | 51 | 52 | 53 | 54 | 55 | 56 | 57 | 58 | 59 | 60 | 61 | 62 |
| inclination angle B (deg.) | 42 | 42 | 42 | 42 | 42 | 42 | 42 | 42 | 42 | 42 | 37 | 37 | 37 | 37 | 37 | 30 | 30 |
| dynamic loft angle A (deg.) | 36 | 37 | 38 | 39 | 40 | 41 | 42 | 43 | 44 | 45 | 46 | 47 | 48 | 49 | 50 | 51 | 52 |
| catch angle C (deg.) | 12 | 11 | 10 | 9 | 8 | 7 | 6 | 5 | 4 | 3 | 7 | 6 | 5 | 4 | 3 | 9 | 8 |

In the first and second golf clubs 1A and 1B, the catch angles C of the upper groove walls 8*b* of the score lines 8 show positive values when striking the ball.

Thus, the first and second golf clubs 1A and 1B can exert a large shearing force on the struck ball, and thereby it is possible to significantly increase the backspin of the ball. As a result, in an approach shot, for example, it is possible for such a high backspin ball to stop at a desired position, therefore, it is possible to obtain excellent controllability.

In the example shown in Table 1, the values of the inclination angles B of the first golf clubs 1A are 28 and 42 degrees. Needless to say, the inclination angles B are not limited to these two values. The inclination angles B may have values between 28 and 42 degrees.

In this example, naturally, the minimum value and the maximum value of the inclination angle B are 30 degrees and 40 degrees, respectively, for the first golf clubs 1A, and 25 degrees and 35 degrees, respectively, for the second golf club 1B.

In this Table 2, the values of the dynamic loft angle "A" which were determined assuming that they are 10 degrees smaller than the respective loft angles A' in the standard state, and the catch angles C (=90-A-B) obtained therefrom are indicated. Additionally, such values of the optional third golf clubs 1C are also indicated.

TABLE 2

| | first golf club | | | | | | | | | | second golf club | | | | | third golf club | |
|---|---|---|---|---|---|---|---|---|---|---|---|---|---|---|---|---|---|
| loft angle A' (deg.) | 46 | 47 | 48 | 49 | 50 | 51 | 52 | 53 | 54 | 55 | 56 | 57 | 58 | 59 | 60 | 61 | 62 |
| inclination angle B (deg.) | 30 | 30 | 30 | 30 | 30 | 30 | 30 | 30 | 30 | 30 | 25 | 25 | 25 | 25 | 25 | 20 | 20 |
| dynamic loft angle A (deg.) | 36 | 37 | 38 | 39 | 40 | 41 | 42 | 43 | 44 | 45 | 46 | 47 | 48 | 49 | 50 | 51 | 52 |
| catch angle C (deg.) | 24 | 23 | 22 | 21 | 20 | 19 | 18 | 17 | 16 | 15 | 19 | 18 | 17 | 16 | 15 | 19 | 18 |
| loft angle A' (deg.) | 46 | 47 | 48 | 49 | 50 | 51 | 52 | 53 | 54 | 55 | 56 | 57 | 58 | 59 | 60 | 61 | 62 |
| inclination angle B (deg.) | 40 | 40 | 40 | 40 | 40 | 40 | 40 | 40 | 40 | 40 | 35 | 35 | 35 | 35 | 35 | 30 | 30 |
| dynamic loft angle A (deg.) | 36 | 37 | 38 | 39 | 40 | 41 | 42 | 43 | 44 | 45 | 46 | 47 | 48 | 49 | 50 | 51 | 52 |
| catch angle C (deg.) | 14 | 13 | 12 | 11 | 10 | 9 | 8 | 7 | 6 | 5 | 9 | 8 | 7 | 6 | 5 | 9 | 8 |

When the golf club set includes the above-mentioned first group of a plurality of the first golf clubs 1A, the first golf clubs 1A are preferably configured so that the inclination angles B of the respective clubs 1A are gradually decreased as the loft angles increase. By configuring so, it becomes possible to make the catch angles C substantially constant regardless of the loft angles of the first golf clubs 1A.

Also it is possible to configure the second golf clubs 1B in the second group in the same manner as above.

Preferably, the inclination angles B of the groove walls 8*b* of the score lines 8 of the first golf clubs 1A are set in a range from 30 to 40 degrees.

Preferably, the inclination angles B of the groove walls 8*b* of the score lines 8 of the second golf clubs 1B are set in a range from 25 to 35 degrees.

Table 2 shows an example of values satisfying these preferable ranges, of the inclination angles B of the groove walls 8*b* of the score lines 8 and the loft angles A'.

More preferably, the inclination angles B of the groove walls 8*b* of the score lines 8 of the first golf clubs 1A are set in a range from 32 to 38 degrees.

More preferably, the inclination angles B of the groove walls 8*b* of the score lines 8 of the second golf clubs 1B are set in a range from 27 to 33 degrees.

Table 3 shows an example of values satisfying these more preferable ranges, of the inclination angles B of the groove walls 8*b* of the score lines 8 and the loft angles A'.

In this example, naturally, the minimum value and the maximum value of the inclination angle B are 32 degrees and 38 degrees, respectively, for the first golf clubs 1A, and 27 degrees and 33 degrees, respectively, for the second golf club 1B.

In this Table 3, the values of the dynamic loft angle "A" which were determined assuming that they are 10 degrees smaller than the respective loft angles A' in the standard state, and the catch angles C (=90-A-B) obtained therefrom are indicated. Additionally, such values of the optional third golf clubs 1C are also indicated.

TABLE 3

| | first golf club | | | | | | | | | | second golf club | | | | | third golf club | |
|---|---|---|---|---|---|---|---|---|---|---|---|---|---|---|---|---|---|
| loft angle A' (deg.) | 46 | 47 | 48 | 49 | 50 | 51 | 52 | 53 | 54 | 55 | 56 | 57 | 58 | 59 | 60 | 61 | 62 |
| inclination angle B (deg.) | 32 | 32 | 32 | 32 | 32 | 32 | 32 | 32 | 32 | 32 | 27 | 27 | 27 | 27 | 27 | 20 | 20 |
| dynamic loft angle A (deg.) | 36 | 37 | 38 | 39 | 40 | 41 | 42 | 43 | 44 | 45 | 46 | 47 | 48 | 49 | 50 | 51 | 52 |
| catch angle C (deg.) | 22 | 21 | 20 | 19 | 18 | 17 | 16 | 15 | 14 | 13 | 17 | 16 | 15 | 14 | 13 | 19 | 18 |

TABLE 3-continued

| | first golf club | | | | | | | | | | | second golf club | | | | | third golf club | |
|---|---|---|---|---|---|---|---|---|---|---|---|---|---|---|---|---|---|---|
| loft angle A' (deg.) | 46 | 47 | 48 | 49 | 50 | 51 | 52 | 53 | 54 | 55 | 56 | 57 | 58 | 59 | 60 | | 61 | 62 |
| inclination angle B (deg.) | 38 | 38 | 38 | 38 | 38 | 38 | 38 | 38 | 38 | 38 | 33 | 33 | 33 | 33 | 33 | | 30 | 30 |
| dynamic loft angle A (deg.) | 36 | 37 | 38 | 39 | 40 | 41 | 42 | 43 | 44 | 45 | 46 | 47 | 48 | 49 | 50 | | 51 | 52 |
| catch angle C (deg.) | 16 | 15 | 14 | 13 | 12 | 11 | 10 | 9 | 8 | 7 | 11 | 10 | 9 | 8 | 7 | | 9 | 8 |

The catch angles C are preferably set in a range of not less than 6 degrees, more preferably not less than 8 degrees, still more preferably not less than 10 degrees in order to increase the backspin of the ball sufficiently.

On the other hand, if the catch angle C becomes too large, there is a possibility that the contact area between the ball and the upper groove wall 8*b* of the score line 8 is reduced rather when striking the ball.

From this point of view, it is preferable that the catch angle C is set in a range of not more than 20 degrees, more preferably not more than 18 degrees, still more preferably not more than 15 degrees.

As explained above, the catch angle C (deg.) is defined by the following equation (II), using the dynamic loft angle "A" (deg.) defined by the following formula (I):

$$A=A'-\delta \quad \text{(I)}$$

$$C=90-A-B \quad \text{(II)}$$

wherein

A' is the loft angle of the golf club concerned, and

δ is an angle value selected from a range from 8 to 10 degrees.

The widths (groove widths) and depths (groove depths) of the score lines 8 and the spacing between the score lines 8 may be set to any value as far as the Golf Rules are satisfied.

Comparison Tests

<Comparison of Contact Area Between Groove Wall and Ball by Hitting Test>

FIG. 6 shows results of a hitting test conducted by using a first golf club of an embodiment of the present invention (under side), and a golf club as a comparative example (upper side).

The inclination angle B of the groove wall in the embodiment was 30.0 degrees. The inclination angle B of the groove wall in the comparative example was 17.5 degrees. The loft angle in the standard state was 58 degrees in both of the embodiment and comparative example.

In the hitting test, each golf club was attached to a swing robot, and struck a ball at a head speed of 16 m/s, at a dynamic loft angle of 50 degrees (i.e., δ in the formula (1) was set to 8 degrees), wherein the surface of the ball was colored with a black magic marker to be easily viewable.

Figure 7:
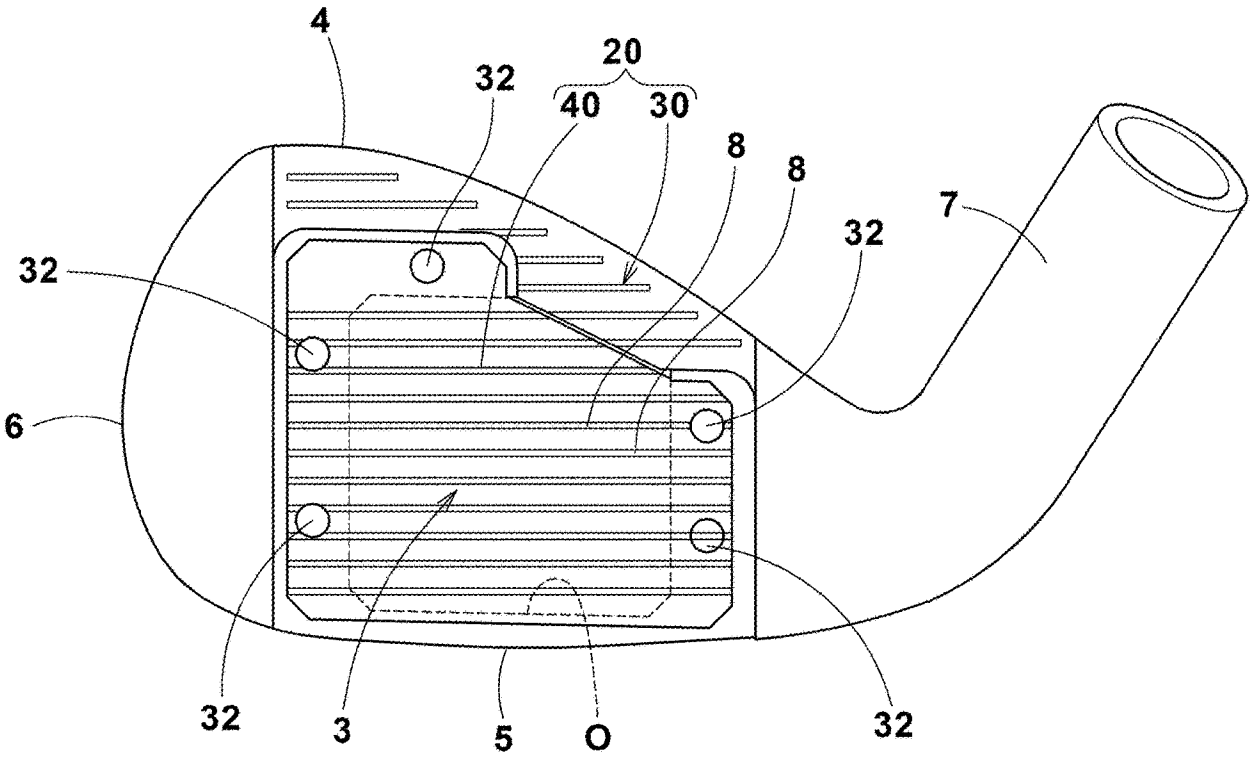
FIG. 7 is a front view of a golf club head having a transparent face plate and used in a first ball hitting test.

Each golf club used in the hitting test had a golf club head 20 shown in FIG. 7. The golf club head 20 was composed of a main body 30 provided with a through-hole o, and a face plate 40 fixed to the main body 30 by using screws 32 so as to close the through-hole o. The face plate 40 was formed of a transparent acrylic plate whose front surface forming a ball striking face 3 was provided with score lines 8 for testing.

In the hitting test, the contact state between the ball and the face 3 was observed through the through-hole o from the rear of the head and recorded by a high-speed camera.

Figures 6A, 6B, 6C:
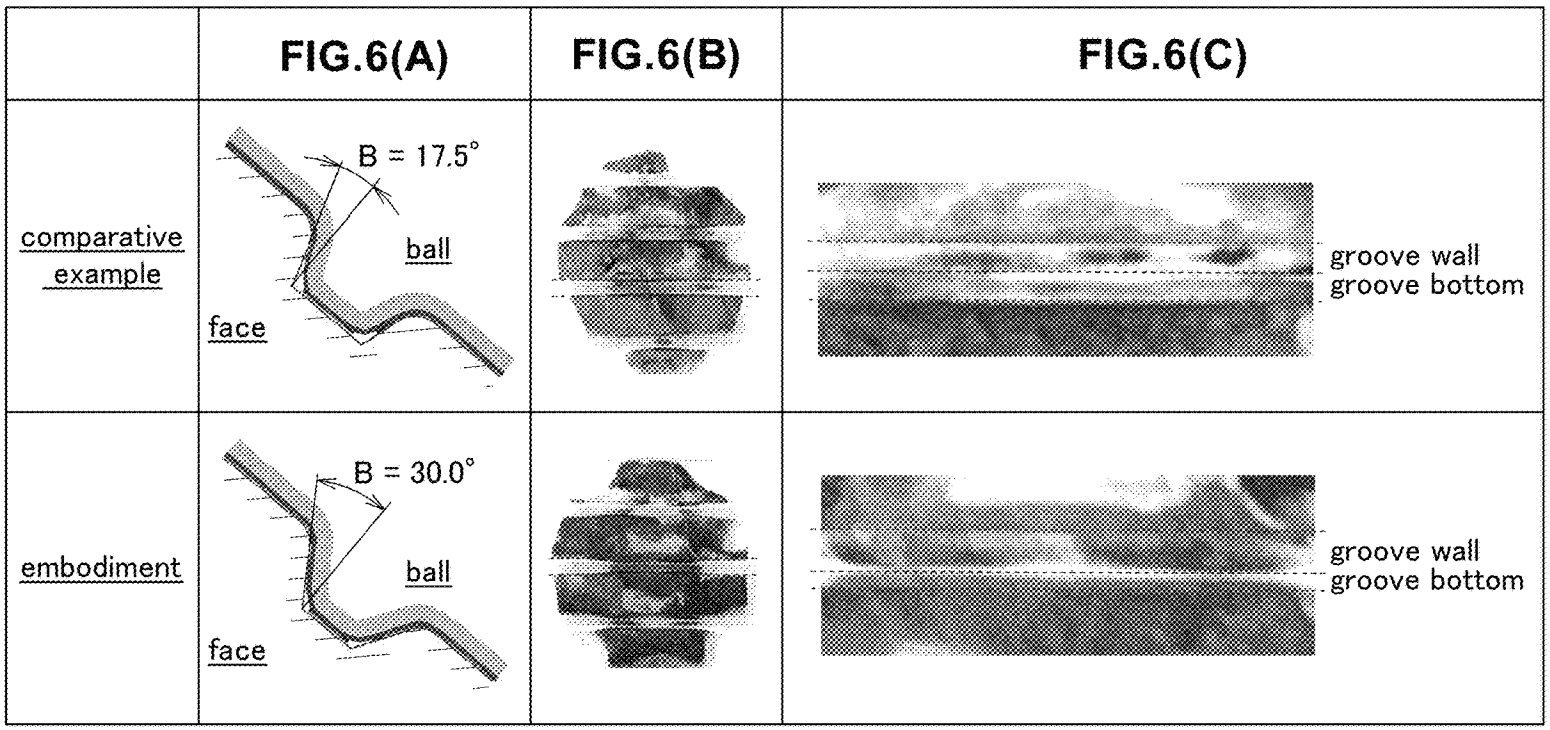

The observed contact state between the score line and the ball is shown in FIG. 6(A) as a view from a side of the head. As shown, in the embodiment, the ball could contact with the groove walls to a deeper position of the score line as compared to the comparative example.

The observed contact state is shown in FIG. 6(B) as a view from the back side of the face, wherein the deeper the black level, the stronger the contact is or the closer the distance is. As shown, focusing on the regions in the score lines, the deeper black area was larger in the embodiment than the comparative example.

Further, the observed contact state is shown in FIG. 6(C) as a view from a diagonally side of the face, wherein the deeper the black level, the stronger the contact is or the closer the distance is. As shown, focusing on the groove wall of the score line, the deeper black area was larger in the embodiment than the comparative example.

<Comparison of Shear Force Exerted on Face by Hitting Test>

Figure 8:
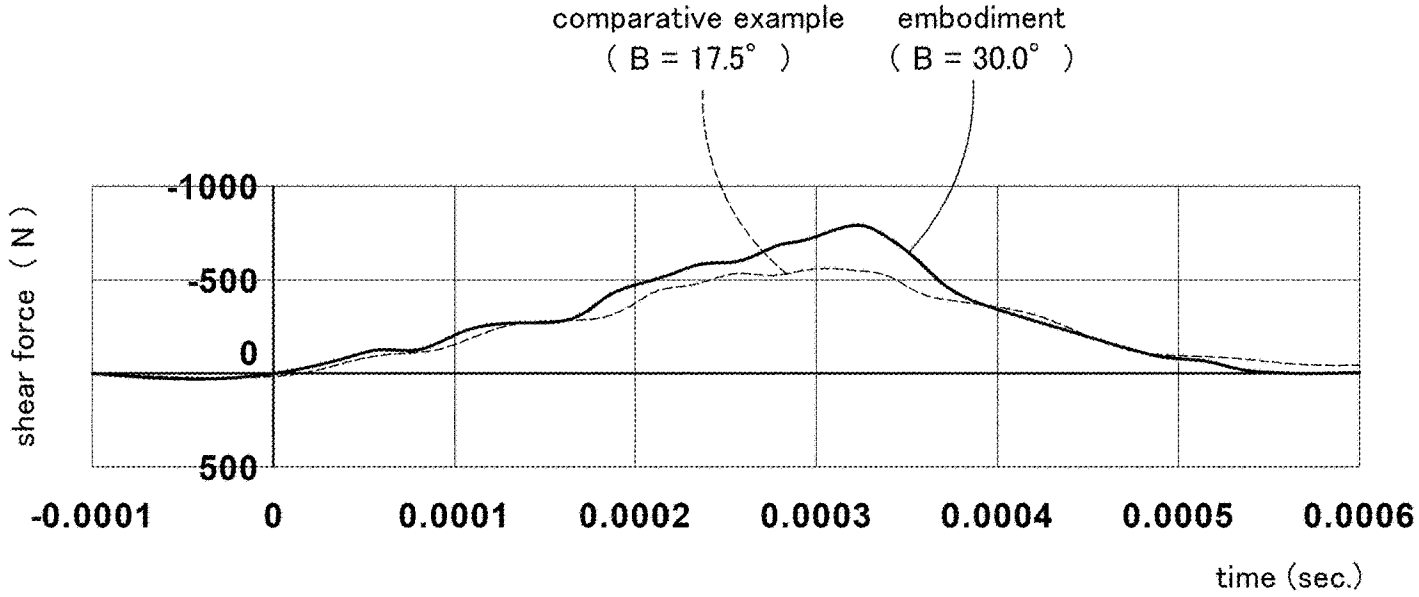
FIG. 8 is a graph showing results of a second ball hitting test wherein the shear force acting on the face is shown as a function of the elapsed time.

FIG. 8 is a graph of the shear force exerted on the face as a function of the time elapsed during the contact between the ball and the face obtained through a second hitting test.

As shown, the peak value of the shear force of the embodiment was high, and the impulse was also large as compared to the comparative example.

Figure 9:
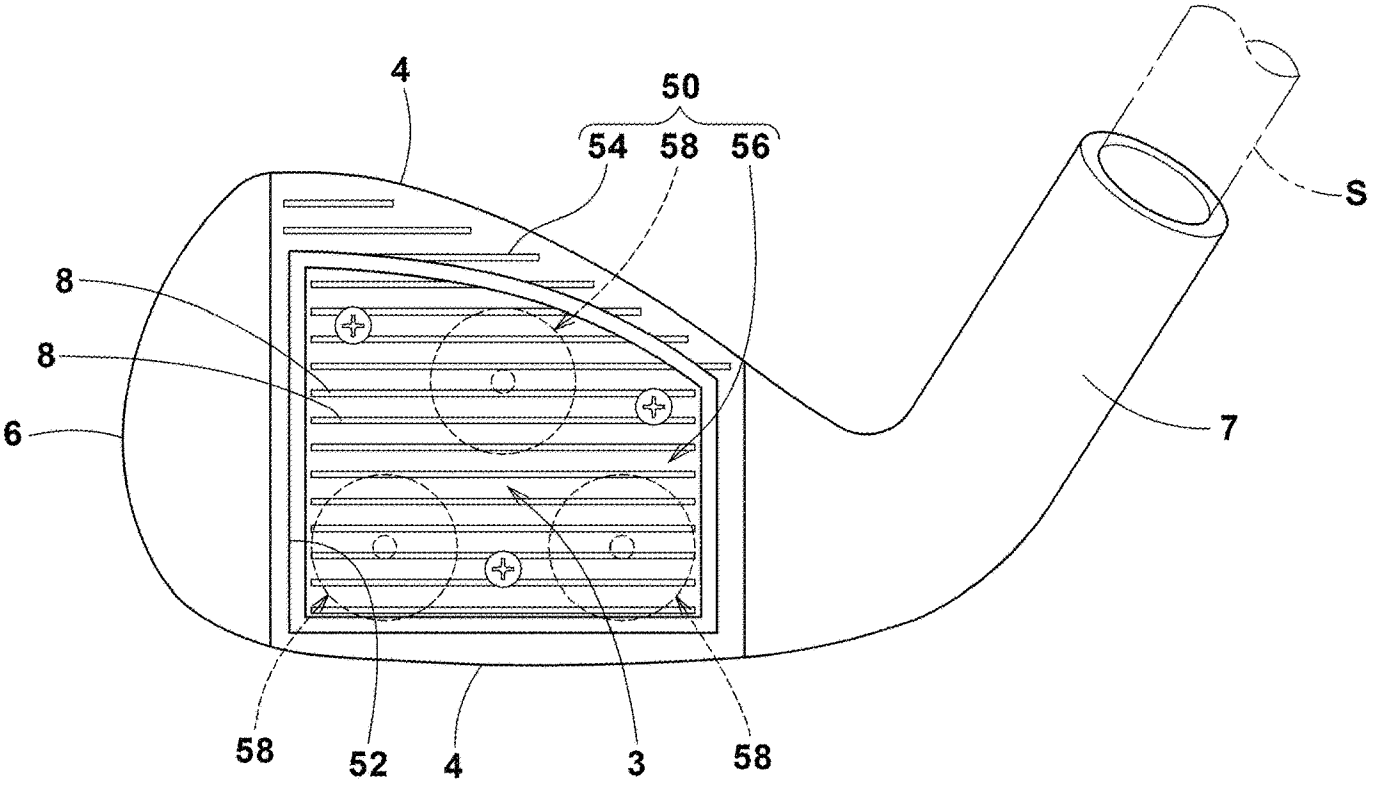
FIG. 9 is a front view of a golf club head provided with force sensors and used in the second ball hitting test.

Each golf club used in the second hitting test had the club head 50 shown in FIG. 9.

The golf club head 50 was composed of a main body 54 provided with a recess 52, a face plate 56 fixed to the main body 54 by using screws so as to cover the recess 52, and force sensors 58 disposed in the recess 52 to measure forces acting on the face plate 56.

In the second hitting test, by using the golf club head 50, the shear force acting on the face plate 56 during the ball was contacting with the face plate 56 was measured.

<Backspin of the Ball>

First golf clubs, second golf clubs and third golf clubs having various angle values shown in Table 4 were experimentally manufactured, and a third hitting test was conducted to measure the backspin of the ball struck by each club.

In the third hitting test, each golf club was attached to a swing robot, and struck a ball at a head speed of 16 m/s.

In this test, lawn was adhered to the surface of the ball in advance so that the lawn existed between the face and the ball in the same condition when striking the ball.

The test results are shown in Table 4.

TABLE 4

| | first golf club(B = 28-42 deg.) | | | | | | second golf club(B = 32-37 deg.) | | | | | third golf club(B = 20-30 deg.) | |
|---|---|---|---|---|---|---|---|---|---|---|---|---|---|
| club ID code | A1 | A2 | A3 | B1 | B2 | B3 | C1 | C2 | C3 | D1 | D2 | E1 | E2 |
| loft angle A' (deg.) | 48 | 48 | 48 | 52 | 52 | 52 | 56 | 56 | 56 | 60 | 60 | 64 | 64 |
| inclination angle B (deg.) | 30 | 35 | 40 | 30 | 35 | 40 | 25 | 30 | 35 | 25 | 30 | 20 | 25 |
| dynamic loft angle A (deg.) | 40 | 40 | 40 | 44 | 44 | 44 | 48 | 48 | 48 | 52 | 52 | 56 | 56 |
| catch angle C (deg.) | 20 | 15 | 10 | 16 | 11 | 6 | 17 | 12 | 7 | 13 | 8 | 14 | 9 |
| backspin (index) | 95.5 | 98.0 | 100 | 97.6 | 100 | 96.2 | 95.8 | 100 | 96.8 | 100 | 96.6 | 98 | 98 |

| | first golf club(B = 28-42 deg.) | | | second golf club(B = 23-37 deg.) | | | | |
|---|---|---|---|---|---|---|---|---|
| club ID code | F | G1 | G2 | H1 | H2 | H3 | I1 | I2 |
| loft angle A' (deg.) | 48 | 52 | 52 | 56 | 56 | 56 | 60 | 60 |
| inclination angle B (deg.) | 17.5 | 17.5 | 25 | 40 | 17.5 | 40 | 17.5 | 40 |
| dynamic loft angle A (deg.) | 40 | 44 | 44 | 48 | 48 | 48 | 52 | 52 |
| catch angle C (deg.) | 33 | 28.5 | 21 | 2 | 25 | 2 | 21 | −2 |
| backspin (index) | 88.0 | 89.5 | 94.2 | 93.2 | 91.4 | 91.2 | 94.6 | 85.2 |

The golf club set according to the present invention can include at least one selected from the first golf clubs A1-B3 and at least one selected from the second golf clubs C1-D2 shown in Table 4.

The at least one selected from the first golf clubs A1-B3 can include one selected from the first golf clubs A1-A3 and one selected from the first golf clubs B1-B3.

The at least one selected from the second golf clubs C1-D2 can include one selected from the second golf clubs C1-C3 and one selected from the second golf clubs D1-D2.

Further, the golf club set according to the present invention can include at least one selected from the third golf clubs E1-E2 shown in Table 4.

Thus, it was confirmed through the third hitting test that the backspin is significantly increased in the golf club set according to the present invention.

While detailed description has been made of preferable embodiments of the present invention, the present invention can be embodied in various forms without being limited to the illustrated embodiments.

DESCRIPTION OF THE REFERENCE SIGNS

1 golf club
1A first golf club
1B second golf club
1C third golf club
2 golf club head
3 face
8 scoreline
8*a* groove bottom
8*b* groove wall
A dynamic loft angle
B groove walls' inclination angle
C catch angle

The invention claimed is:

1. A golf club set comprising golf clubs having different loft angles, said golf clubs including:

at least one first golf club having a loft angle not less than 46 degrees and less than 56 degrees, at least one second golf club having a loft angle not less than 56 degrees and less than 60 degrees, and at least one third golf club having a loft angle more than 60 degrees and not more than 64 degrees, wherein said at least one first golf club, said at least one second golf club and said at least one third golf club each comprise a face provided with score lines, the score lines are each formed by a groove having a groove bottom and a pair of opposite groove walls which are inclined at an inclination angle with respect to a normal direction to the face so that the groove width between the opposite groove walls is increased from the groove bottom toward the face, the inclination angle of the groove walls of the score lines of said at least one first golf club is in a range from 28 to 42 degrees, the inclination angle of the groove walls of the score lines of said at least one second golf club is in a range from 23 to 37 degrees and smaller than that of the first golf club, and the inclination angle of the groove walls of the score lines of said at least one third golf club is in a range from 20 to 30 degrees and smaller than that of the second golf club.

2. The golf club set according to claim 1, wherein the inclination angle of the groove walls of the score lines of the first golf club is in a range from 30 to 40 degrees, and the inclination angle of the groove walls of the score lines of the second golf club is in a range from 25 to 35 degrees and less than that of the first golf club.

3. The golf club set according to claim 2, wherein said at least one first golf club and said at least one second golf club each have a catch angle C in a range of from 6 to 20 degrees, and the catch angle C is defined by the following formula (II), using a dynamic loft angle "A" defined by the following formula (I), $$A=A'-\delta \quad \text{(I)}$$

$$C=90(\text{deg.})-A(\text{deg.})-B(\text{deg.}) \quad \text{(II)}$$

wherein

A' is the loft angle of the golf club concerned,

δ is an angle value selected from a range from 8 to 10 degrees, and

B is the inclination angle of the groove walls of the score lines of the golf club concerned.

4. The golf club set according to claim 3, wherein said catch angle is in a range of not less than 10 degrees and not more than 15 degrees.

5. The golf club set according to claim 3, wherein in each of the score lines, the groove wall on the upper side of the score line is inclined forward of a vertical line drawn passing through an intersection between the groove wall and the groove bottom.

6. The golf club set according to claim 1, wherein the inclination angle of the groove walls of the score lines of the first golf club is in a range from 32 to 38 degrees, and the inclination angle of the groove walls of the score lines of the second golf club is in a range from 27 to 33 degrees and less than that of the first golf club.

7. The golf club set according to claim 6, wherein said at least one first golf club and said at least one second golf club each have a catch angle C in a range of from 6 to 20 degrees, and the catch angle C is defined by the following formula (II), using a dynamic loft angle "A" defined by the following formula (I), $$A=A'-\delta \quad \text{(I)}$$

$$C=90(\text{deg.})-A(\text{deg.})-B(\text{deg.}) \quad \text{(II)}$$

wherein

A' is the loft angle of the golf club concerned,

δ is an angle value selected from a range from 8 to 10 degrees, and

B is the inclination angle of the groove walls of the score lines of the golf club concerned.

8. The golf club set according to claim 7, wherein said catch angle is in a range of not less than 10 degrees and not more than 15 degrees.

9. The golf club set according to claim 7, wherein in each of the score lines, the groove wall on the upper side of the score line is inclined forward of a vertical line drawn passing through an intersection between the groove wall and the groove bottom.

10. The golf club set according to claim 1, wherein said at least one first golf club and said at least one second golf club each have a catch angle C in a range of from 6 to 20 degrees, and the catch angle C is defined by the following formula (II), using a dynamic loft angle "A" defined by the following formula (I), $$A=A'-\delta \quad \text{(I)}$$

$$C=90(\text{deg.})-A(\text{deg.})-B(\text{deg.}) \quad \text{(II)}$$

wherein

A' is the loft angle of the golf club concerned,

δ is an angle value selected from a range from 8 to 10 degrees, and

B is the inclination angle of the groove walls of the score lines of the golf club concerned.

11. The golf club set according to claim 10, wherein said catch angle is in a range of not less than 10 degrees and not more than 15 degrees.

12. The golf club set according to claim 10, wherein in each of the score lines, the groove wall on the upper side of the score line is inclined forward of a vertical line drawn passing through an intersection between the groove wall and the groove bottom.

13. The golf club set according to claim 1, wherein in each of the score lines, the opposite groove walls are arranged symmetrically about the groove center line of the score line.

14. The golf club set according to claim 1, wherein said at least one first golf club, said at least one second golf club and said at least one third golf club are iron golf clubs.

* * * * *